US005238087A

United States Patent [19]

Garrido et al.

[11] Patent Number: 5,238,087

[45] Date of Patent: Aug. 24, 1993

[54] ADVANCED ENERGY SAVING HYDRAULIC ELEVATOR

[75] Inventors: Alfonso Garrido; Jose Sevilleja; Armando Servia, all of Madrid, Spain

[73] Assignee: Otis Elevator Company, Farmington, Conn.

[21] Appl. No.: 876,543

[22] Filed: Apr. 30, 1992

[51] Int. Cl.[5] ..... B66B 11/04

[52] U.S. Cl. ..... 187/17; 187/94

[58] Field of Search ..... 187/17, 94

[56] References Cited

U.S. PATENT DOCUMENTS

| | | | |
|---|---|---|---|
| 965,542 | 7/1910 | Schuller | 187/17 |
| 1,277,567 | 9/1918 | Garrison | 187/94 X |
| 2,906,374 | 9/1959 | Brumby | 187/17 |
| 3,905,496 | 9/1975 | Reeder | 187/17 X |
| 4,703,835 | 11/1987 | Negrutsky et al. | 187/17 |
| 5,056,627 | 10/1991 | Pelto-Huikko | 187/94 X |

FOREIGN PATENT DOCUMENTS

| | | |
|---|---|---|
| 2735310A1 | 8/1977 | Fed. Rep. of Germany . |
| 3629032A1 | 4/1988 | Fed. Rep. of Germany . |
| 1-242386 | 9/1989 | Japan . |

*Primary Examiner*—Robert P. Olszewski
*Assistant Examiner*—Dean A. Reichard

[57] ABSTRACT

An hydraulic elevator utilizes a double acting cylinder to drive a counterweighted elevator upwardly and downwardly. The weight of the counterweight is approximately equal to the weight of the car plus 50% of the duty load of the elevator.

1 Claim, 1 Drawing Sheet

ADVANCED ENERGY SAVING HYDRAULIC ELEVATOR

TECHNICAL FIELD

This invention relates to an energy efficient hydraulic elevator.

BACKGROUND OF THE INVENTION

Conventional hydraulic elevators utilize a hydraulically driven ram to raise and lower an elevator car. Conversely, traction elevators utilize a wire rope having one end attached to a car and a second end attached to a counterweight. The rope passes over a sheave which is driven by an electric motor. Traction forces generated between the sheave and the rope raise and lower an elevator car.

Hydraulic elevators require a great deal more installed power compared to conventional traction elevators. The motor in an hydraulic elevator has to deliver the total energy corresponding to the total weight of the car plus the total weight of the load inside the car. The hydraulic elevator may require more than four times the power used by the same size traction elevators since the use of the counterweight balances the weight of the car and approximately 50% of the weight of the load. Basically the required power (Pt) in a traction elevator is:

$$Pt = \frac{DL}{2} \times V$$

Where

DL=Duty Load

V=Duty Speed

In contrast, in an hydraulic elevator the weight of the car should be a minimum 20% heavier than the duty load to provide the minimum fluid pressure force required by the hydraulic system to operate accurately in an empty car down condition. As such the required power $P_H$ in an hydraulic elevator is:

$$P_H=(C_W+D_L)\times V$$

Where

Car Wght=$C_W$=1.2 $D_L$

And, substituting for $C_W$ and V:

$$P_H=(1.2D_L+D_L)\times V=2.2D_L\times V=4.4Pt.$$

Because the required power for the hydraulic elevator is 4.4 times that of the traction elevator, motor power is dimensioned for more than four times the equivalent motor power of a traction elevator.

To address the problem, some hydraulic elevators are equipped with a counterweight which balances approximately 80% of the car weight since a minimum pressure is still needed for an empty car down condition to permit the hydraulic systems to operate accurately. These systems require power as follows:

$$Phcwt=(Cwnb+D_L)\times V_L$$

Where

Cwnb=Non balanced car weight

Cwnb=20% $D_L$

And substituting for Cwnb and $V_L$:

$$Phcwt=(0.2D_L+D_L)\times V_L=1.2D_LV_L=2.4Pt$$

Such counterweighted hydraulic elevators require a motor to have more than twice the peak power required for an equivalent traction elevator.

DISCLOSURE OF THE INVENTION

It is an object of the invention to minimize the amount of energy used by the hydraulic elevator.

It is an object of the invention to optimize the cost, weight and size of the components of an hydraulic elevator including the car, hydraulic fluid, guide rails, hydraulic pump, cylinder and piston.

It is a further object of the invention to improve the comfort of the elevator passengers.

According to the invention, an hydraulic elevator utilizes a double acting cylinder to drive a counterweighted elevator upwardly and downwardly.

According to a feature of the invention, the counterweight is approximately equal to the weight of the car plus 50% of the duty load, essentially similar to the weight of a traction elevator.

According to an embodiment of the invention, the hydraulic elevator has a pulley system which acts as multiplier means for moving the elevator car a distance greater than a stroke of a driving ram, the multiplier means connecting the ram to the counterweighted elevator.

These and other objects, features, and advantages of the present invention will become more apparent in light of the following detailed description of a best mode embodiment thereof, as illustrated in the accompanying drawing.

BEST MODE FOR CARRYING OUT THE INVENTION

Figure 1:
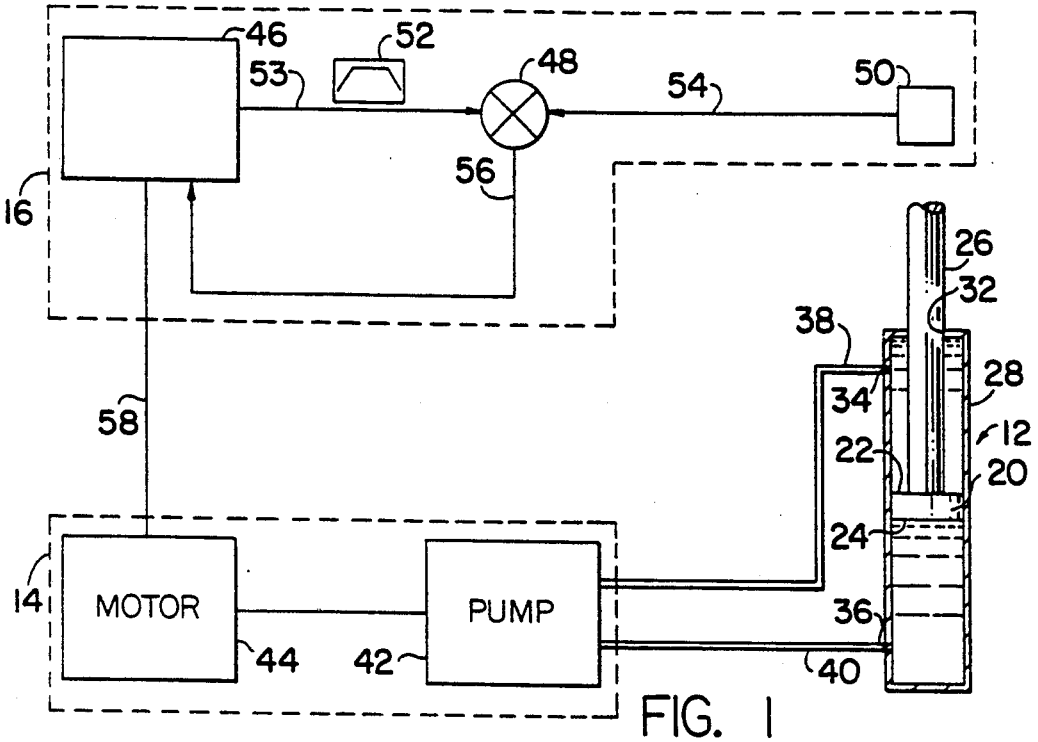
FIG. 1 is a schematic depiction of a control system for the hydraulic elevator of the invention.
Figure 2:
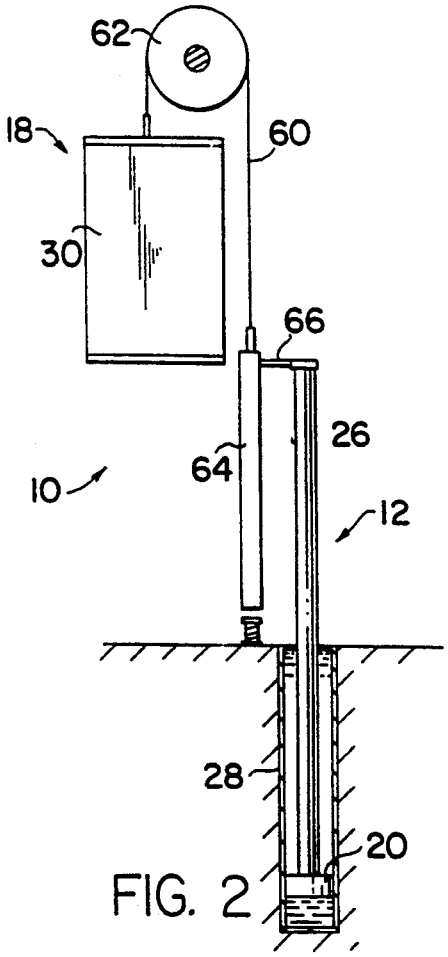
FIG. 2 is a schematic depiction of a first embodiment of the hydraulic elevator of the invention.
Figure 3:
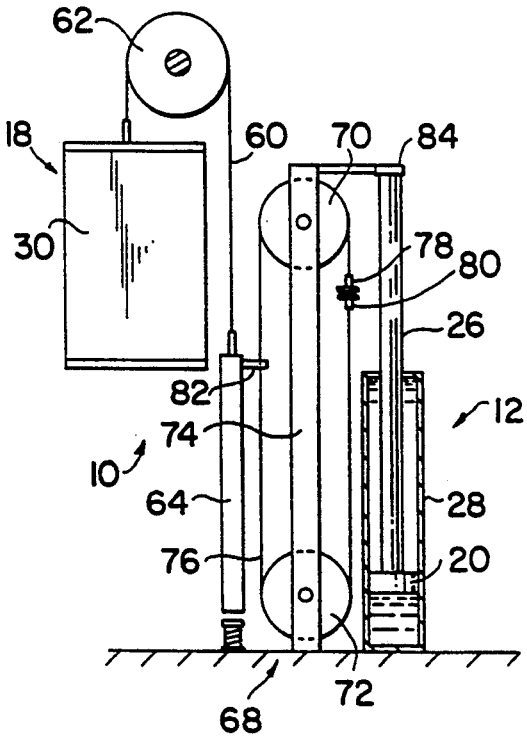
FIG. 3 is a schematic depiction of a second embodiment of the hydraulic elevator of the invention.

Referring to FIGS. 1-3, two embodiments of a hydraulic elevator 10 of the invention are shown. The elevator is comprised of an hydraulic ram 12, a drive system 14, a control system 16, and a counterweighted elevator 18.

The hydraulic ram 12 is comprised of a head 20, having a first reaction surface 22 and a second reaction surface 24, a piston 26 attaching to the head by conventional means, and a cylinder 28. The piston 26 reacts in tension or in compression depending only on the load in the car 30, with maximum tension at full load, a balanced force for a balanced load and maximum compression with an empty car. The head 20 is surrounded by a conventional seal (not shown) attached thereto for preventing fluid from flowing around the head within the cylinder 28.

The cylinder 28 has an opening 32 for slidingly and sealingly receiving the piston as is known in the art. The cylinder also has a first port 34 and a second port 36 for communicating hydraulic fluid into and out of the cylinder via first line 38 and second line 40 respectively.

The drive system 14 is comprised of a variable flow pump 42 which is driven by a reversible motor 44. The pump 42 impels hydraulic fluid to act upon either the first or second reaction surfaces 22, 24 of the head 20 via the first line 38 or second line 40 depending on the direction of rotation of the motor 44. The motor is controlled by the control system 16.

Referring to FIG. 1, the control system 16 is comprised of a controller 46, a comparator 48, and a conventional position and velocity transducer 50, or the like. The controller 46 sends a desired velocity and position signal in accordance with a desired car travel profile 52, such profiles being known in the art, to the comparator 48 via line 53. The transducer 50 sends the actual elevator position and velocity to the comparator via line 54. The comparator compares the actual elevator position and velocity with the desired position and velocity and sends a correction signal to the controller via line 56. The controller then sends a signal via line 58 to the motor 44 to control the flow of hydraulic fluid to the cylinder 28 via first line 38 or second line 40 as is necessary to cause the elevator car 30 to travel in accordance with the desired profile. As known in the art, the position and velocity transducer 50 is mounted upon the elevator car.

Referring to FIG. 2, a first embodiment of the counterweighted elevator 18 is comprised of a car 30, a rope 60, an idler sheave 62, and a counterweight 64. As is known in the art, the rope, which passes over the sheave, has a first end attached to the car and a second end attached to the counterweight. The counterweight is weighted to balance the weight of the car plus 50% of the duty load. The sheave is arranged so that the car may be suspended, via the rope, from atop its center of gravity. A linkage 66 mechanically connects the counterweight to the piston 26 at a top portion thereof.

Referring to FIG. 3, a second embodiment of the elevator 10 of the invention is shown. If the rise of the elevator or construction practices do not permit a hole to be dug to install the cylinder 28, a 2:1 roping configuration may be utilized which permits the cylinder to be installed on a side of the car 30. As shown, a pulley system 68 is used to implement the 2:1 roping configuration.

The pulley system 68 is comprised of a top pulley 70 and a bottom pulley 72 mounted for rotation upon either end of a metallic tube 74. The length of the tube 74 is a function of the rise of the elevator. A rope 76 has a first end 78 which attaches to the hoistway (not shown), wraps over the top pulley 70, wraps under the bottom pulley 72 and has a second end 80 which attaches to the hoistway. The counterweight 64 is attached to the rope via linkage 82. The upper end of the tube is mechanically connected to the piston by means of linkage 84.

The system works in such a way that when the piston 26 moves a distance d, the rope 76 moves a distance of 2 d. Because the counterweight 64 is rigidly connected to the rope 76, it will also move 2d and, consequently, the car 30 moves twice the distance of the piston in the upward and downward direction independent of the load in the car.

In both embodiments, When hydraulic fluid is pumped in the cylinder 28 via line 40, the fluid pressure force applied on the second reaction surface 24 of the head 20 elevates the piston 26 thereby causing the car 30 to descend. When hydraulic fluid is pumped in the cylinder via line 38, the fluid pressure force applied on the first reaction surface 22 of the head causes the piston to descend and the car 30 to rise.

This hydraulic elevator system has the following advantages:

Energy consumption is optimized and installed power is minimized because the weight of the elevator and 50% of the duty load is balanced by the counterweight. As such, the required power is:

$$P_{AH} = \frac{D_L}{2} \times V = P_L$$

Therefore, the peak power required is equivalent to a traction elevator and is less than half the value of any hydraulic elevator with a counterweight and less than one quarter of the value of conventional hydraulic elevator.

The cost and size of the motor, pump, and feeder lines may be downsized due to the efficiency of the system.

The size of the ram may be minimized because the forces acting thereupon have been minimized relative to conventional hydraulic elevator systems.

The amount of oil is minimized because less is needed to react upon the piston head.

The weight and cost of the car is minimized because the car does not have to be a particular weight to have an accurate downrun. Theoretically, the system will work even with zero car weight.

Because the car is suspended atop its center of gravity, the size and cost of car guides (not shown) can be dramatically reduced when compared to a conventional hydro roped 2:1 with a cantilevered car, because the forces acting upon the guide shoes or rollers are hugely reduced. Further, the comfort of the passengers inside the car will also be improved since no overhung load will be applied to the guides.

The system is electronically controlled and hence does not depend on the accuracy of any electromechanical valves or spoolers. Therefore, the hydraulic system is much more reliable since it depends on the hydraulic pump which is common to any conventional system.

Although, the invention has been shown and described with respect to a best mode embodiment thereof, it should be understood by those of ordinary skill in the art, that various omission, changes and additions in the form and detail thereof may be made without departing from the spirit and scope of the invention. One of ordinary skill in the art will recognize that the piston may be connected to any part of the counterweighted elevator which can impart movement to the car.

We claim:

1. An hydraulic elevator comprising:

a counterweighted elevator comprising a car, a counterweight, and a rope connecting said car and said counterweight;

a ram having a first reaction surface for driving one of said car or said counterweight upwardly and a second reaction surface for driving one of said car or said counterweight downwardly;

multiplier means for moving said car a distance greater than a stroke of said ram, said multiplier means connecting said ram to said counterweighted elevator, said multiplier means comprising:

a first pulley;

a second pulley;

means for rigidly connecting said first and second pulley, said means having a length corresponding to a rise of said hydraulic elevator, said means attaching to said ram; and a pulley rope which:

has a first end attaching to a first fixed point, extends about said first pulley, extends about said second pulley, and has a second end attaching to a second fixed point.

* * * * *